US008715116B2

(12) United States Patent
Cerasoli

(10) Patent No.: US 8,715,116 B2
(45) Date of Patent: May 6, 2014

(54) COLLAPSIBLE, PORTABLE SPORT GOAL

(75) Inventor: Guy Cerasoli, Englewood, CO (US)

(73) Assignee: King's Court Leisure Sports, LLC, Englewood, CO (US)

( * ) Notice: Subject to any disclaimer, the term of this patent is extended or adjusted under 35 U.S.C. 154(b) by 165 days.

(21) Appl. No.: 13/247,508

(22) Filed: Sep. 28, 2011

(65) Prior Publication Data

US 2012/0077629 A1 Mar. 29, 2012

Related U.S. Application Data

(60) Provisional application No. 61/387,414, filed on Sep. 28, 2010.

(51) Int. Cl.
*A63B 63/00* (2006.01)
*F16B 21/00* (2006.01)

(52) U.S. Cl.
USPC ..... 473/478; 403/325

(58) Field of Classification Search
USPC ..... 473/478, 523; 294/19.2; 403/325, 327, 403/331, 351; 56/328.1; 92/15
See application file for complete search history.

(56) References Cited

U.S. PATENT DOCUMENTS

| | | | | | |
|---|---|---|---|---|---|
| 1,844,410 | A | * | 2/1932 | Schalk | 403/327 |
| 2,546,387 | A | * | 3/1951 | Coffing | 279/79 |
| 2,841,425 | A | * | 7/1958 | Oeters | 403/104 |
| 3,799,099 | A | * | 3/1974 | Conover | 114/221 R |
| 4,247,216 | A | * | 1/1981 | Pansini | 403/109.3 |
| 4,711,595 | A | * | 12/1987 | Magid et al. | 403/108 |
| 4,836,542 | A | * | 6/1989 | Crawley | 473/432 |
| 4,948,149 | A | * | 8/1990 | Lin et al. | 473/492 |
| 5,346,227 | A | * | 9/1994 | Amram et al. | 273/400 |
| 5,412,835 | A | * | 5/1995 | Vosbikian et al. | 15/257.7 |
| 5,580,064 | A | * | 12/1996 | Childers, Jr. | 273/400 |
| 5,590,974 | A | * | 1/1997 | Yang | 403/327 |
| 5,655,774 | A | * | 8/1997 | Cox | 473/478 |
| 5,695,195 | A | | 12/1997 | John et al. | |

(Continued)

FOREIGN PATENT DOCUMENTS

| | | | |
|---|---|---|---|
| JP | 2004-057312 | A | 2/2004 |
| WO | WO 99-06125 | A1 | 2/1999 |
| WO | WO 01-37948 | A1 | 5/2001 |

OTHER PUBLICATIONS

International Preliminary Report on Patentability prepared by the Korean Intellectual Property Office as the International Searching Authority for PCT International Patent Application No. PCT/US2011/053674, mailed Apr. 11, 2013, 6 pages.

(Continued)

*Primary Examiner* — Gene Kim
*Assistant Examiner* — M Chambers
(74) *Attorney, Agent, or Firm* — Swanson & Bratschun, L.L.C.

(57) ABSTRACT

This disclosure primarily concerns sports goals. In an aspect, some of these sports goals are collapsible and/or portable. In some novel configurations, a sports goal might be collapsible into an easily carried configuration without any need to remove the net of the goal. In another configuration, a sports goal might have members that attach using a novel attachment mechanism that requires much less effort and frustration than conventional attachments. In yet another configuration, a sports goal might have a net that is secured to the goal frame with a novel reinforcement system that prevents the net from tearing away from the goal frame when struck with a high-velocity ball or puck.

11 Claims, 8 Drawing Sheets

(56) References Cited

U.S. PATENT DOCUMENTS

| | | | | |
|---|---|---|---|---|
| 6,629,900 | B2 | 10/2003 | Wu | |
| 6,672,980 | B1 | 1/2004 | Walsh | |
| 6,979,274 | B1 | 12/2005 | Raber | |
| 7,125,351 | B1 | 10/2006 | Raber | |
| 7,334,957 | B2 * | 2/2008 | Sadinsky et al. | 403/109.3 |
| 7,371,195 | B2 | 5/2008 | Stevens | |
| 2007/0066423 | A1 | 3/2007 | Morrow | |
| 2012/0077629 | A1 * | 3/2012 | Cerasoli | 473/478 |

OTHER PUBLICATIONS

International Search Report and Written Opinion prepared by the U.S. Patent and Trademark Office as International Searching Authority for PCT International Patent Application No. PCT/US11/53674, mailed Apr. 24, 2012, 9 pages.

* cited by examiner

16ea
14e
12e
16db
14f
12d
16eb
16da
14c
14d
16fa
16bb
12c
16cb
16ca
10
12b
12f
14b
16fb
16ba
14a
16aa
16ab
12a
16fb
24a
24b
26

18
30
22d
22a
16aa
20a
22b
20b
24c
22c
28
14a

COLLAPSIBLE, PORTABLE SPORT GOAL

CROSS-REFERENCES TO RELATED APPLICATIONS

This application claims the benefit, under 35 U.S.C. §119 (e), of co-pending provisional U.S. Patent Application No. 61/387,414 filed Sep. 28, 2010 by Guy Cerasoli and titled "Collapsible Portable Sport Goal," which is hereby incorporated by reference, as if set forth in full in this document, for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to sporting equipment and more particularly, to goal structures for sporting events.

BACKGROUND

Many different sports and games employ physical goals, into which a puck or ball is shot, kicked, or thrown. Examples include lacrosse, soccer and hockey, to name a few. Traditionally, such goals have been installed as semi-permanent fixtures on a sports field or rink. Even if not fixed to the field, such goals typically are too heavy and/or unwieldy to truly be considered portable. Thus, traditional goals typically have been used only for formal sporting events. For more informal events, nontraditional goals, such as two pylons, have been used to form a makeshift goal.

As sports have gained increasing popularity in our culture, and technology has advanced, many sports have evolved to allow a blending of formal and informal sporting events. Along with this evolution, a need developed for more flexible sporting equipment to accommodate these type of games. For example, street hockey is often played in a neighborhood street with a goal that can be carried (or dragged) into a player's garage when the game is over; likewise, many pickup soccer and lacrosse games are played in an open field with a smaller, more portable net that might be transportable with a pickup truck or sports utility vehicle.

As part of that evolution, some have developed "collapsible" or "portable" goals. Most typically, such goals fall into three camps: those that are portable but not easily collapsible, such as goals that can be completely disassembled for transportation but which are frustrating and time-consuming to reassemble; those that are collapsible but not easily portable, such as goals that can be quickly folded into a flat configuration but are still too large to be easily carried or transported in a normal automobile; and those that are collapsible and easily portable, such as goals that have a wire frame that twists into itself to be compact and flat but when set up for game use are flimsy and not truly in a traditional square or rectangular configuration.

Thus, there is a need for a sports goal that can be easily disassembled into a configuration that is easy to carry by hand and/or transport in a normal automobile while maintaining the necessary rigidity and form for traditional game use.

BRIEF SUMMARY

Certain embodiments provide sports goals. In an aspect, some of these sports goals are collapsible and/or portable. In some novel configurations, a sports goal might be collapsible into an easily carried configuration without any need to remove the net of the goal. In another configuration, a sports goal might have members that attach using a novel attachment mechanism that requires much less effort and frustration than conventional attachments. In yet another configuration, a sports goal might have a net that is secured to the goal frame with a novel reinforcement system that prevents the net from tearing away from the goal frame when struck with a high-velocity ball or puck. Thus, various embodiments can provide numerous improvements over existing sports goals. Moreover, many of the innovations developed in conjunction with the sports goals described herein can be applied in a number of different contexts, so embodiments should not be considered limited merely to sports goals.

An exemplary sport goal in accordance with one set of embodiments comprises a plurality of frame members that are connected by a plurality of connection members. In an aspect, the sports goal might also include a net, which can be attached to one or more (or, in some cases, all) of the frame members. In another aspect, the sport goal can have an assembled configuration in which the frame members define a goal mouth that rests generally upright upon the ground to receive a ball or puck into the net and an unassembled configuration in which all of the frame members are generally parallel and disposed adjacently.

In a particular set of embodiments, the plurality of frame members includes a first frame member. In an aspect of certain embodiments, the first frame member has a first connecting member fixedly attached to a first end portion of the first frame member. The first frame member might further comprise a second end portion, which can have an insertion portion adapted to be removably inserted within a second connecting member and a non-insertion portion that remains outside the second connecting member when the insertion portion is inserted within the second connecting member. In certain embodiments, the insertion portion might have removed therefrom a kerf to provide relief between an outside perimeter of the insertion portion and an inside perimeter of the second connecting member.

In other embodiments, the second end portion of the first frame member might define first, second, third, and fourth holes in one or more exterior walls of the first frame member. Merely by way of example, if the frame member is cylindrical in shape, all four of the holes might be in a single, circumferential exterior wall; if the frame member has a rectangular or other non-circular cross section, two of the holes might be in one exterior wall, while two of the holes might be in another exterior wall. (In cases in which the frame member is solid, the first and third holes might be embodied by a single hole through the solid body of the frame member, and the second and fourth holes might be embodied by another hole through the solid body of the frame member)

In an aspect, the first hole and the third hole might be disposed within the insertion portion, with the first hole opposing the third hole. In another aspect, the second hole and the fourth hole might be disposed within the non-insertion portion, with the second hole opposing the fourth hole. In some cases, the second connecting member defines opposing fifth and sixth holes in one or more exterior walls of the second connecting member. Thus, in an aspect of some embodiments, when the insertion portion is inserted within the connecting member, the fifth hole aligns with the first hole and the sixth hole aligns with the third hole.

In accordance with other embodiments, the sport goal might further comprise an attachment mechanism disposed within the second end portion of the first frame member. This attachment mechanism might be configured to secure the insertion portion within the second connecting member. In certain embodiments, the attachment mechanism might comprise a first leg having a first protuberance and a second protuberance, and a second leg generally opposing the first leg. The second leg might have a third protuberance and a fourth protuberance. In an aspect, the first protuberance can extend through the first hole and at least partially through the fifth hole and the second protuberance can extend through the second hole. Similarly, the third protuberance might extend through the third hole and at least partially through the sixth hole, and the fourth protuberance might extend through the fourth hole.

In such embodiments, when the insertion portion is inserted within the second connecting member, the first and third protuberances can secure the insertion portion within the second connecting member. Moreover, in some cases, when sufficient force is applied to the second protuberance, the first protuberance withdraws from the fifth hole and when sufficient force is applied to the fourth protuberance, the third protuberance withdraws from the sixth hole, allowing the insertion portion to be removed from the second connecting member.

In further embodiments, the net might comprise a plurality of cords and one or more sleeves (each of which can be disposed around a frame member, or a portion thereof). The net might further comprise a reinforcing element. In an aspect, the reinforcing element might be woven through adjacent cords of the net and secured to the sleeve.

In accordance with yet other embodiments, the net might be attached (e.g., using sleeves, as mentioned above) to each of the plurality of frame members. In such embodiments, the sport goal might be adapted to be disassembled from the assembled configuration to the unassembled configuration while the net remains attached to each of the plurality of frame members. In other embodiments, the sport goal might be adapted to be assembled from the unassembled configuration to the assembled configuration while the net remains attached to each of the plurality of frame members.

Other embodiments provide methods, including methods of using, assembling, or disassembling sports goals such as those described herein. In one aspect, a method might comprise inserting the insertion portion of a frame member into a connecting member so that the first and third protuberances engage the fifth and sixth holes (in the connecting member). The method might further comprise applying force to the second and fourth protuberances to disengage the first and third protuberances from the fifth and sixth holes, and then removing the insertion portion from the connector member. Another method might comprise assembling a collapsible portable sport goal from the unassembled configuration to the assembled configuration while the net remains attached to each of the plurality of frame members, and/or disassembling a collapsible portable sport goal from the assembled configuration to the unassembled configuration while the net remains attached to each of the plurality of frame members.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

Figures 1, 2:
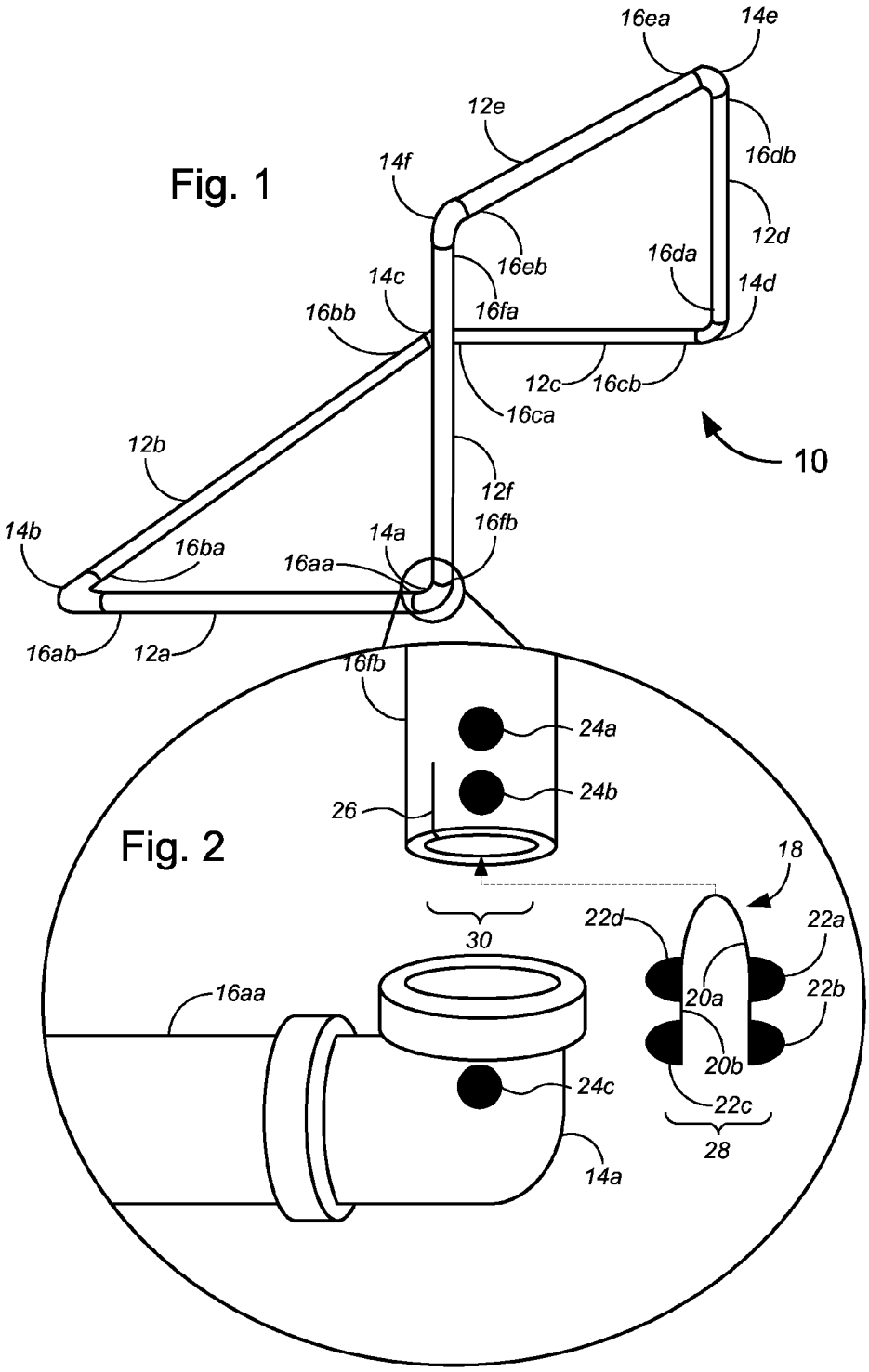
FIG. 1 is a perspective drawing illustrating a frame for a collapsible, portable sport goal, in accordance with various embodiments.
FIG. 2 is an exploded detail drawing illustrating a connection between two members of a collapsible, portable sport goal, in accordance with various embodiments.

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Certain embodiments provide sport goals. In an aspect, some of these sports goals are collapsible and/or portable. In some novel configurations, a collapsible, portable sport goal ("CPSG") might be collapsible into an easily-carried configuration without any need to remove the net of the goal. In another configuration, a sports goal might have members that attach using a novel attachment mechanism that requires much less effort and frustration than conventional attachments. In yet another configuration, a sports goal might have a net that is secured to the goal frame with a novel reinforcement system that prevents the net from tearing away from the goal frame when struck with a high-velocity ball or puck. Thus, various embodiments can provide numerous improvements over existing sports goals. Moreover, many of the innovations developed in conjunction with the sports goals described herein can be applied in a number of different contexts, so embodiments should not be considered limited merely to sports goals.

In some embodiments, a CPSG can fit into a bag that can be carried by one person and easily stored. The CPSG can be very sturdy with joints that fasten together so that it can withstand rigorous use. In some cases, the CPSG consists of tubes, which make up the goalposts, the cross-bars, and the back members of the CPSG, and elbow joints that are attached permanently to the end of one tube and then fasten to the adjacent tube by the use of clips that nest inside the adjacent tube to ensure goal integrity during game play, while ensuring minimal interference with game play. In an aspect, the clips and tubes are designed to be fastened and separated easily from the adjacent elbow joints to make it easy to set up and break down.

A net might be connected (attached) to the tubes. In some cases, when breaking down the CPSG for transport and storage, the tubes and elbow joints are held together as a result of the net, which is attached to the tubes by sleeves that the tubes are inserted through. The sleeves are made of a durable material that can come in a variety of colors. A strip of reinforcing material (such as twill tape, to name an example) might be woven through the net at the net's edge and the sleeves can be sewn together (to form a cylinder to encompass the tube) with the reinforcing material woven through the net in between the sleeves' edges. This technique can provide a sturdy connection and thereby harder wearing use, allowing the CPSG to withstand hard shots from participants of any sport or activity that might make use of the CPSG. In another aspect, the tubes are hollow so that users can anchor the CPSG with the addition of weights into the tubes so that the CPSG will not be as easily displaced during game play.

Thus, certain embodiments can provide numerous advantages. Merely by way of example, in some aspects, a CPSG can be more easily put together and/or taken apart. In other aspects, a CPSG can stay together at the joints during game play even though it is easily taken apart when desired. In yet other aspects, a CPSG can be made from sturdy, hard-wearing material and/or can have a more sturdy connection to the net so that the net and sleeves will last longer under rigorous use. In further aspects, a CPSG can collapse down to be more compact to be easily transported and/or easily stored.

FIG. 1 depicts a front side elevated perspective view of a frame for a CPSG 10 in accordance with some embodiments, without a net attached. Six frame members 12 (e.g., PVC plastic tubes or pipes) each have a connecting member (e.g., a PVC or plastic elbow joint) 14 permanently attached to one end. Each frame member 12 inserts into and fastens to the adjacent connecting member 14 that is permanently attached to the adjacent frame member 12. For example, as illustrated, connecting member 14*a* is fixedly (or permanently) attached to a first end portion 16*aa* of frame member 12*a*, and a second end portion 16*ab* of frame member 12*a* is removably attached to connecting member 14*b*, which is fixedly (or permanently) attached to a first end portion 16*ba* of frame member 12*b* Likewise, a second end portion 16*bb* of frame member 12*b* is removably attached to connecting member 14*c*, which is fixedly (or permanently) attached to a first end portion 16*ca* of frame member 12*c*; a second end portion 16*cb* of frame member 12*c* is removably attached to connecting member 14*d*, which is fixedly (or permanently) attached to a first end portion 16*da* of frame member 12*d*; a second end portion 16*db* of frame member 12*d* is removably attached to connecting member 14*e*, which is fixedly (or permanently) attached to a first end portion 16*ea* of frame member 12*e*; a second end portion 16*eb* frame member 12*e* is removably attached to connecting member 14*e*, which is fixedly (or permanently) attached to a first end portion 16*fa* of frame member 12*f*; a second end portion 16*fb* of frame member 12*f* is removably attached to connecting member 14*a*, which, as noted above is fixedly (or permanently) attached to the first end portion 16*aa* of frame member 12*a*. In this way, certain embodiments can be disassembled easily into constituent pieces, and reassembled, quickly and easily. (It should be noted, of course, that FIG. 1 is exemplary in nature, and that a variety of different arrangements of fixed and/or removable attachments can be used to couple various members in accordance with different embodiments.)

Any number of different types of fixed (or permanent) attachments can be made between a frame member 12 and a connecting member 14. Merely by way of example, in some cases, an adhesive might be used (such as pipe cement, in the cases of PVC members). In other cases, the connecting member 14 and the frame member 12 might be integrally formed (which can be considered a fixed attachment). In yet other cases, the connecting member 14 and the frame member 12 might be attached with a variety of different fasteners, such as screws, brads, staples, and/or the like.

Similarly, removable attachments between members can take a variety of forms, so long as they allow for a secure attachment when desired but easy detachment when disassembly is intended. Merely by way of example, FIG. 2 depicts an exploded detail view of a disassembled corner joint of the CPSG that provides a removable attachment mechanism in the form of a clip 18 that features two legs 20 that are generally opposing (although, as can be seen in FIG. 2, the clip might be a single piece of material, such as steel spring ribbon or other metal that is formed or bent in an acute angle, the two legs 20 can still be considered generally opposing). Each leg 20 features two protuberances, as shown by protuberances 22*a* and 22*b* on leg 20*a* and protuberances 22*c* and 22*d* on leg 20*b*. In some cases, these protuberances can be formed into the clip 18 itself (e.g., through injection molding, stamping or forming, machining, etc.), while in other cases, the protuberances 22 (also referred to herein as "pushbuttons" and "catches," depending on function) might be separate components that are attached (e.g., with adhesive, welding, etc.) to each respective leg 20.

The end portion 16*fb* of the tube 12*f* defines two pairs of holes 24 (of which only one hole of each pair, 24*a* and 24*b* are visible in FIG. 2), left and right pushbutton holes (e.g., 24*a*); and left and right connection holes (e.g., 24*b*). In the illustrated embodiment each hole 24 of a pair is opposing (i.e., through opposing sides of the cylinder formed by tube 12). As described in further detail below, each pair of holes 24 corresponds to the protuberances 22 on one leg 20 of the clip 18.

In some cases, the second end portion (e.g., 16*fb*) of each connecting member 12 has one or more kerfs 26 cut into the end portion to provide relief between the outside perimeter of the insertion portion of the frame member 12 and the inside perimeter of the connecting member 14 to ease connection to, and disconnection from the adjacent elbow (e.g., 14*a*). In some embodiments, there are two opposing kerfs, each cut perpendicular to the angle of insertion of the clip 18. (For ease of illustration, FIG. 2 shows only one kerf 26 that is not cut perpendicular to the angle of insertion of the clip 18.) Alternatively and/or additionally, the end portion 16*b* of the tubes 12 not permanently attached to the elbow joints 14 may also have their outer circumference narrowed slightly by shaving it off in order to ease connection to and disconnection from the adjacent elbow joint 14.

Each elbow joint 14 has opposing left and right holes 24 (only one of which, 24*c*, is shown on FIG. 2) that align with the respective adjacent goalpost connection holes 24*b* when the tube 12 is inserted into the elbow joint 14. The clip 18 is inserted into to the second end portion (e.g., 16*fb*) of each tube 12. As noted above, each clip 18 might have two pairs of catches (e.g., protuberances 22) opposite each other, right and left connection catches 22*b* and 22*c* at the end of the connections arms (also referred to herein as "legs") 20*a* and 20*b*, respectively, of the clip 18, and right and left pushbuttons 22*a* and 22*d* further down (e.g., in some cases, approximately an inch further down) the connection arms 20*a* and 20*b*, respectively, of the clip 18 from the corresponding connection catches 22*b* and 22*c*. In one aspect, the clip 18 is fashioned so the width 28 between the connection arms 20 is substantially same as the inner diameter 30 of the tube 12. In another aspect, and the connection arms 20 of the clip 18 are flexible enough for the catches and pushbuttons to be compressed together so that the clip can be installed into the tube 12. The connecting catches 22*b* and 22*c* match up and are inserted through the corresponding goalpost connection holes (e.g., 24*b*). The pushbuttons 22*a* and 22*d* align with the pushbutton holes (e.g., 24*a*) and extend through the pushbutton holes (e.g., 24*a*).

Figure 3:
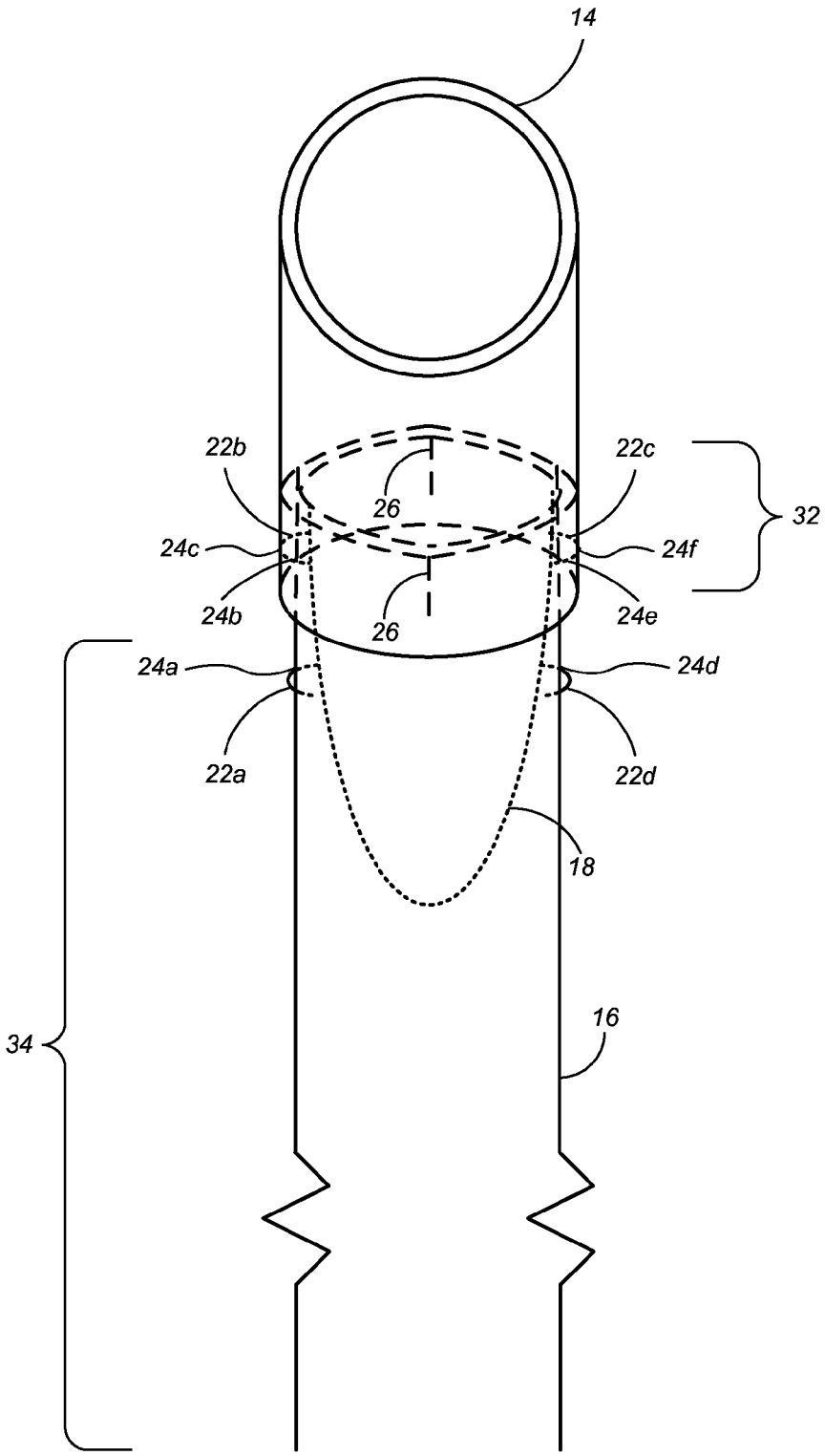
FIGS. 3 and 4 are sectional drawings illustrating a connection between two members of a collapsible, portable sport goal, in accordance with various embodiments.

FIG. 3 depicts an end portion 16 of a tube 12 connected to an elbow joint 14. The end portion 16 comprises an insertion portion 32, which is configured to be inserted into the connecting member (e.g., elbow joint 14) and a non-insertion portion 34, which remains outside the connecting member when the frame member (e.g., tube 12) is attached to the connecting member.

As can be seen from FIG. 3, when the clip 18 is installed in the tube 12 and in place to hold the tube 12 and elbow joint 14 together, the pushbuttons 22*a* and 22*d* extend through holes 24*a* and 24*d* in the non-insertion portion 34. When the insertion portion 32 inserted into the elbow joint 14 to removably attach the tube 12 to the elbow joint 14, the tube connection holes 24*b* and 24*e*, align with the elbow joint connection holes 24*c* and 24*f*, respectively. The connecting catches 22*b* and 22*c* align with and extend through both the tube connection holes 24*b* and 24*e*, respectively, and extend at least partially through the corresponding elbow joint connection holes 24*c* and 24*f*, respectively. The connection catches 22*b* and 22*c* extend through each respective tube connection hole 24*b* and 24*e*, respectively, so that when the tube 12 is inserted into the adjacent elbow joint 14, the connection catches 22*b* and 22*c* extend through the respective elbow joint holes 24*c* and 24*f* to be substantially flush, in some cases, with the outer edge of the elbow joint 14.

In an aspect of some embodiments, the connection catches 22*b* and 22*c* are rounded to ease coupling of the tube 12 with the adjacent elbow joint 14. In another aspect, the pushbuttons 22*a* and 22*d* align with, and extend through, the pushbutton holes 24*a* and 24*d*, respectively. The pushbuttons 22*a* and 22*d* extend through the pushbutton holes, 24*a* and 24*d*, respectively enough to protrude from the outer surface of the tube 12, so that through simultaneous application of sufficient force on the pushbuttons 22*a* and 22*d* (e.g., with one's finger(s) and opposing thumb), the connection arms 18 flex inward toward each other so the connection catches 22*b* and 22*c* withdraw sufficiently from of the elbow joint holes 24*c* and 24*f*, respectively, to clear the inner surface of the exterior wall of the elbow joint 14 so that the tube 12 can slide and be removed from the adjacent elbow joint 14. As noted above, the tube 12 might have two kerfs 26 cut perpendicular to the angle of insertion of the clip 18 to ease connection to and disconnection of the end portion 16 from the adjacent elbow joint 14.

Figure 4:
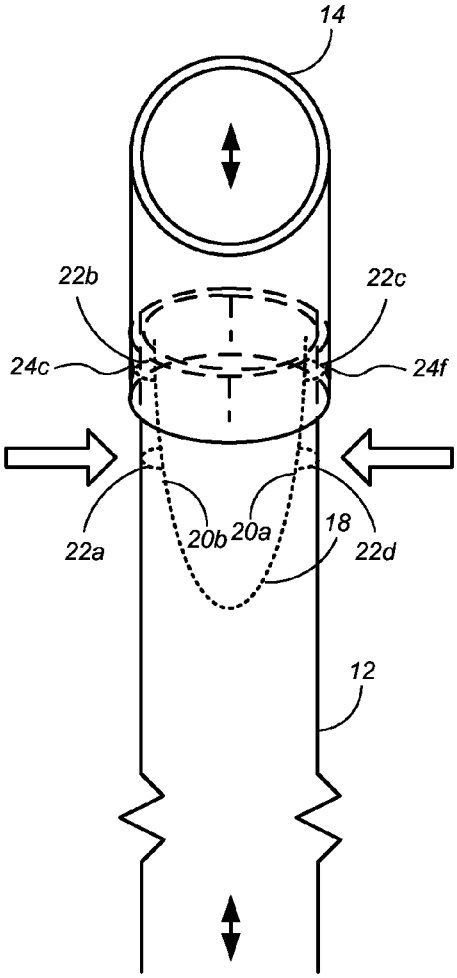
Figure 5:
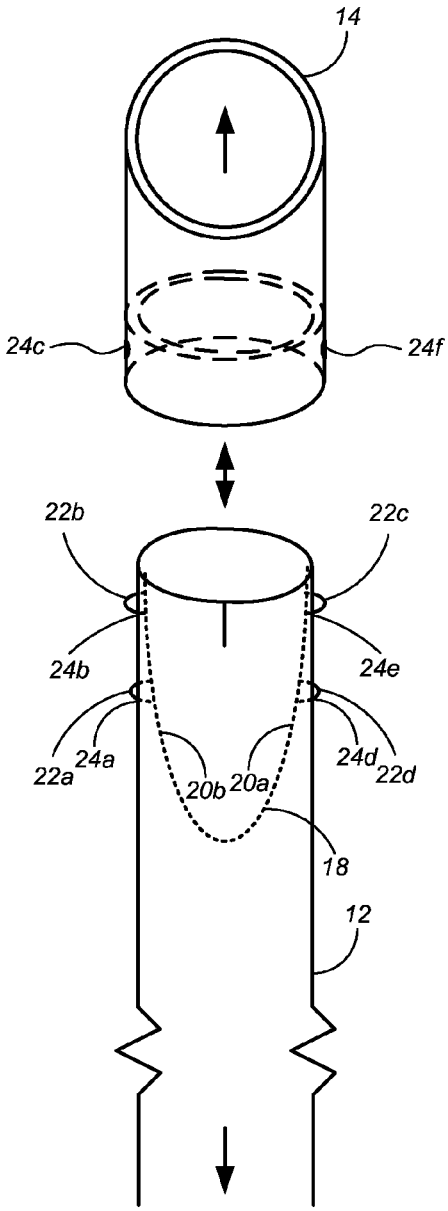
FIG. 5 is an exploded sectional drawing illustrating a connection between two members of a collapsible, portable sport goal, in accordance with various embodiments.

FIG. 4 depicts a tube 12 being disconnected from an elbow joint 14. The application of inward compression on the pushbuttons 22*a* and 22*d* of the clip 18 cause the connection arms CA to flex inward toward each other until the connection catches 22*b* and 22*c* clear the inner edge of the elbow joint holes 24*c* and 24*f*, respectively, so the tube 12 can slide and be removed from the elbow joint 14. FIG. 5 depicts a tube 12 disconnected from an elbow joint 14 with the connection arms 20*a* and 2*b* recoiled back to their original position. The connection catches 22*b* and 22*c* and the pushbuttons 22*a* and 22*d* revert back through the tube connection holes 24*b* and 24*e*, and pushbutton holes 24*a* and 24*d*, respectively.

Figure 6:
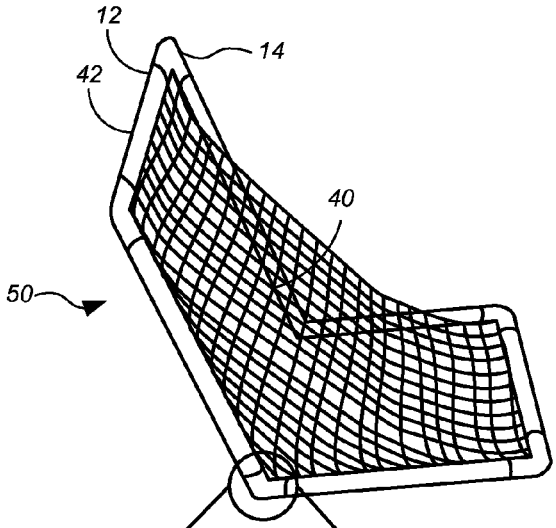
FIG. 6 is a perspective drawing illustrating a sport goal with a net, in accordance with various embodiments.

FIG. 6 depicts a perspective view of the CPSG in an assembled configuration with a net 40 attached (to provide a goal mouth 50 that generally rests upright upon the ground to receive a ball, puck, etc. into the net 40 during game play. The tubes 12 are inserted through sleeves 42 that are attached to the net 40. Each sleeve 42 might comprise a sheet of a suitably durable and flexible material, such as canvas, ballistic nylon, and/or the like.

Figure 7:
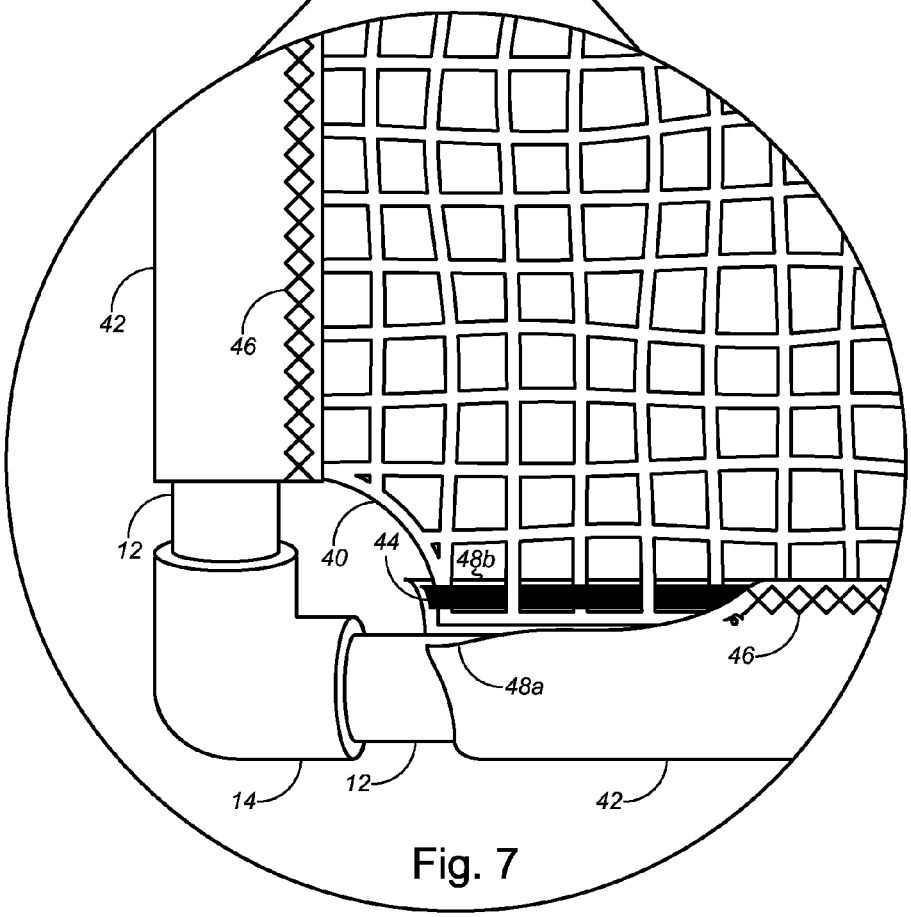
FIG. 7 is a detail drawing illustrating a connection between a net and a sport goal frame, in accordance with various embodiments.

In the illustrated embodiment, the elbow joints 14 are outside the sleeves 42 at the corners of the CPSG. FIG. 7 is a detail drawing of a partially disassembled net 40 and sleeve 42 assembly with the tubes 12 inserted through the sleeves 42. The net 40 has a reinforcing material (such as twill tape 44) that is woven alternately in front of and behind each successive cord in the net 40 parallel to and at the edge of the net 40. The sleeve 42 is depicted as folded back upon itself with the net 40 where the reinforcing material 44 is woven into the net 40 in between the two edges of the sleeve 42 to secure the net 40 to the sleeve. The edges of the sleeve 42 are matched up to be flush with each other and the reinforcing material 44 in between and then sewn together with heavy duty thread 46 to secure one edge 48*a* of the sleeve 42 to the other edge 48*b* (and to secure the reinforcing material 44, and thereby the net 40, to the sleeve). It should be appreciated, of course, that a variety of different reinforcing materials other than twill tape may be used, and a variety of different techniques, such as adhesive, heat sealing, and the like, can be used to secure the edges 48 of the sleeve 42 to one another and/or to secure the net 40 and/or reinforcing material 44 to the sleeve 42. Tubes 12 run through the sleeve 20 and connect to the adjacent elbow joint 14 as depicted in FIG. 2.

Figure 8:
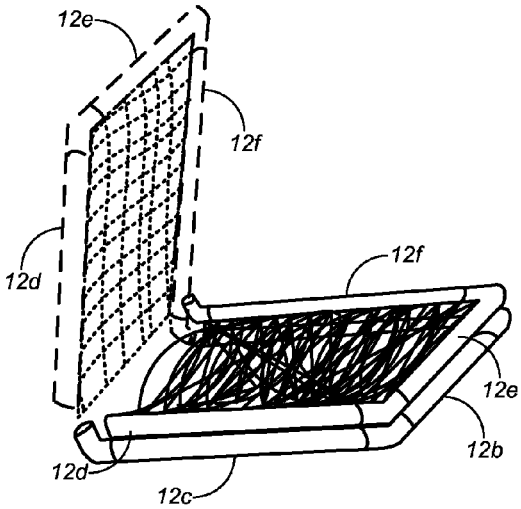
FIGS. 8-11 are perspective drawings illustrating techniques for collapsing a collapsible, portable sport goal, in accordance with various embodiments.
Figure 9:
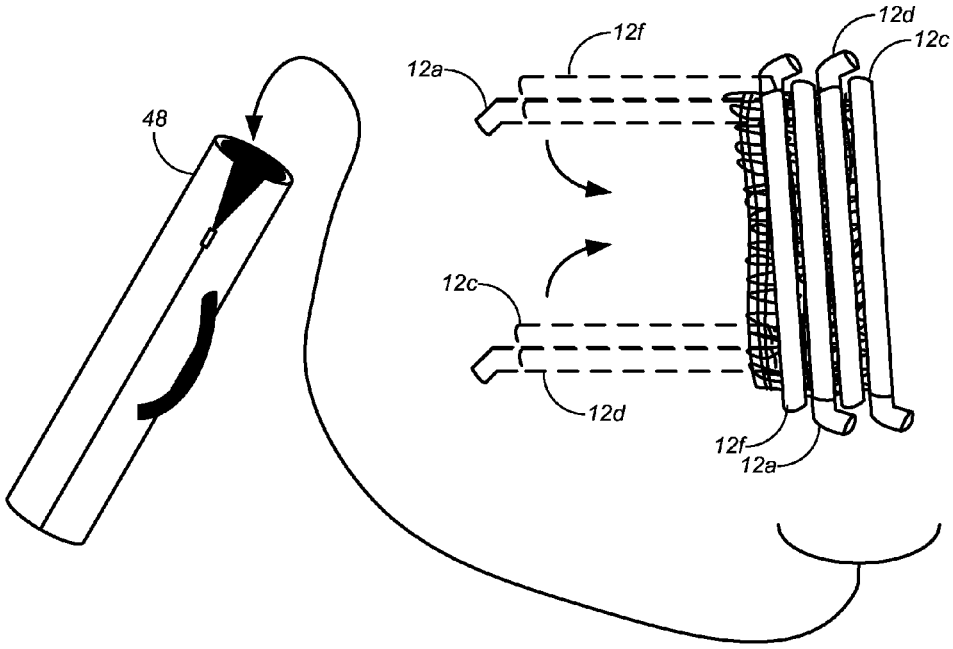

FIG. 8 depicts the CPSG 10 partially disassembled at the points where the upright tubes 12*d* and 12*f* are detached from the back member tubes 12*a* (not visible on FIG. 8) and 12*c* so that the CPSG can be folded in half. Each of the tubes 12 can remain inserted through the sleeves 42 of the net 40 and are thereby held together by the net 40 and the sleeves 42. FIG. 9 depicts the CPSG 10 even further disassembled to an unassembled configuration at points where the upright tubes 12*d* and 12*f* and back member tubes 12*a* and 12*c* are detached from the crossbar tubes 12*b* and 12*e* (not visible on FIG. 9, so that the goalposts can be folded in to be parallel (and generally adjacent) one another, while being held together by the net 40 and sleeves 42. The tubes 12 are compact enough when broken down in this manner to be put into the carrying bag 48.

Notably, the CSPG 10 can be disassembled to this unassembled configuration without removing the net 40 or sleeves 42 from any of the tubes 12 to which they are attached. Moreover, in an aspect, the entire unassembled net can be stored in a bag 48 that is substantially the same length (e.g., in some cases less than 5% greater than the length of the longest tube 12 (assuming the tubes are not all the same length), or in other cases, less than 10% greater than the length of the longest tube). For example, in one embodiment, the tubes 12 are 40 inches long (although other lengths are certainly possible in other embodiments, including embodiments in which the tubes 12 do not all have the same length), and the unassembled net can fit into a bag that is 48 inches long. Moreover, the unassembled net can fit into a bag 48 with a relatively small cross section. For example, if the tubes 12 are constructed from 2 inch cylindrical pipe, the goal 10 easily can fit into a bag with an 80 square inch cross section.

Figure 10:
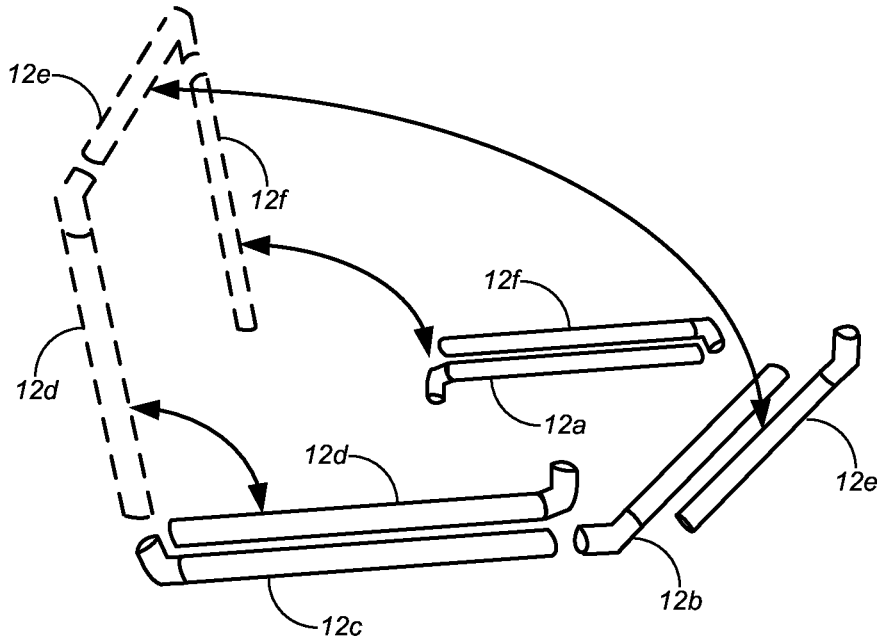
Figure 11:
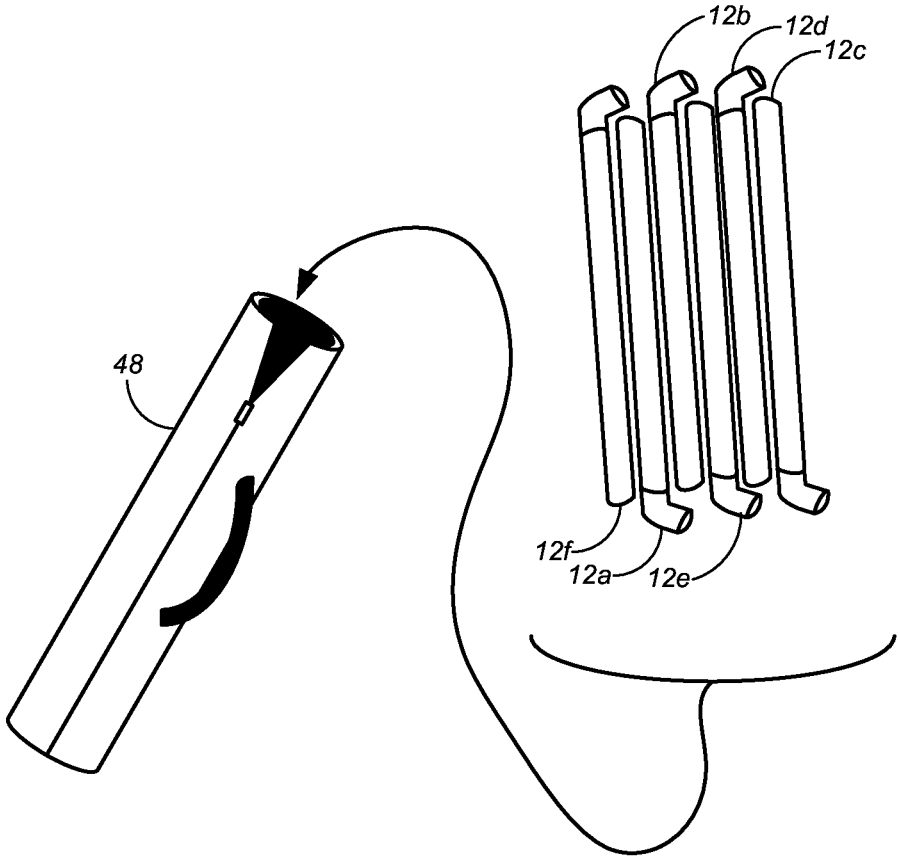

FIGS. 10 and 11 depict the CPSG 10 without the net 40 or the sleeves so that the viewer can better understand how the goal is disassembled. FIG. 10 illustrates that the upright tubes 12*d* and 12*f* can be detached from the back member tubes 12*a* and 12*c* and then folded in half. FIG. 11 illustrates that the upright tubes 12*d* and 12*f* and back member tubes 12*a* and 12*c* can be detached from the crossbar tubes 12*b* and 12*e*, so that the goalposts can be folded in to be parallel with each other so that they are then compact enough to fit into the carrying bag 48.

While embodiments of a CPSG are described above, it should be appreciated that the inventive features of the CPSG can be used in other embodiments as well. For instance, the attachment mechanisms described herein (and the nature of the connections between frame members and connection members) can be employed in a variety of contexts in which a secure, but easily-disconnectable, connection is required. Examples include, but are not limited to, tent poles, sun shades and portable gazebos, shelving, and the like. Thus, embodiments are not limited to sports goals and frames, but can employ the inventive connection, reinforcement, and/or collapsibility features described herein within a variety of different contexts.

Figure 13:
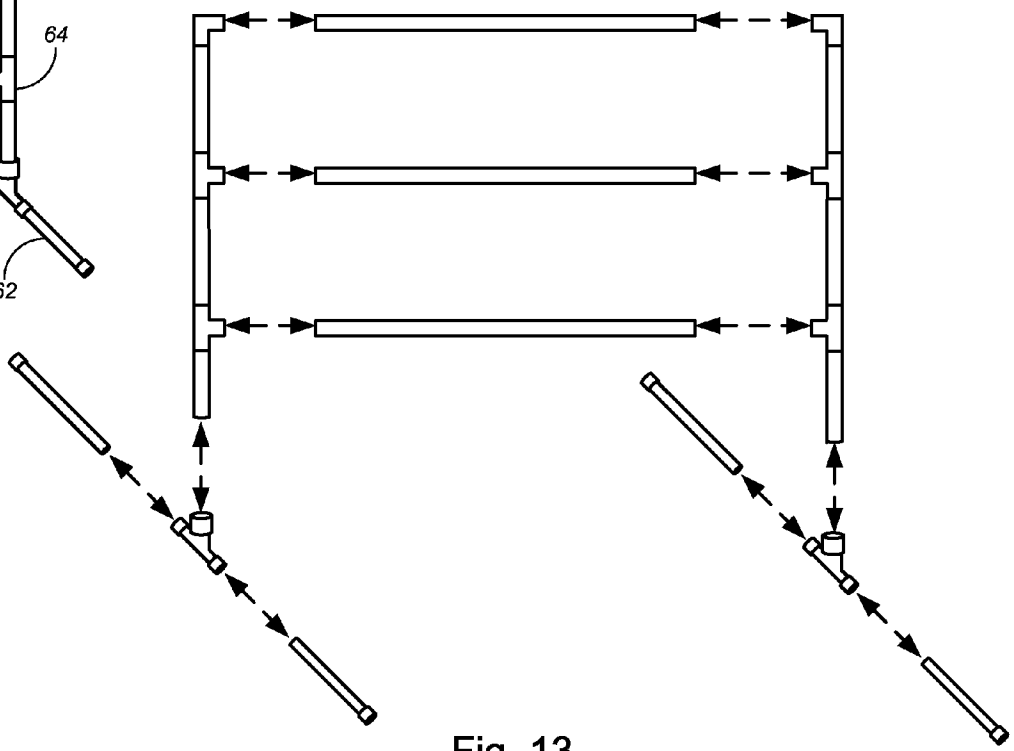
FIG. 13 is an exploded perspective drawing illustrating a collapsible, portable frame, in accordance with various embodiments.
Figure 12:
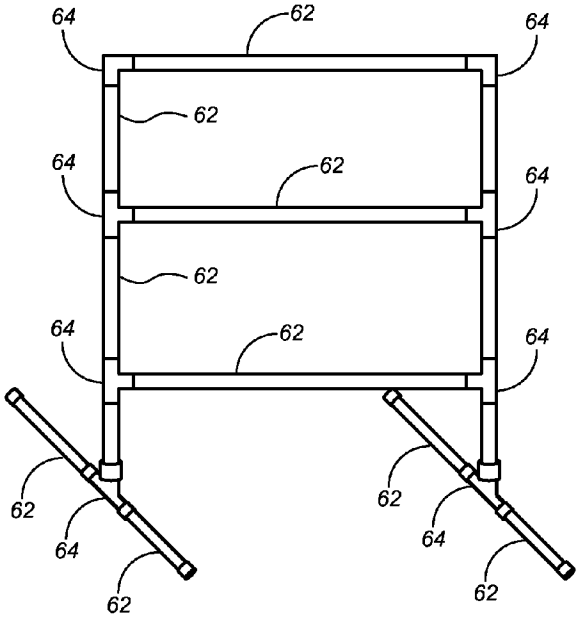
FIG. 12 is a perspective drawing illustrating a collapsible, portable frame, in accordance with various embodiments.
Figure 15:
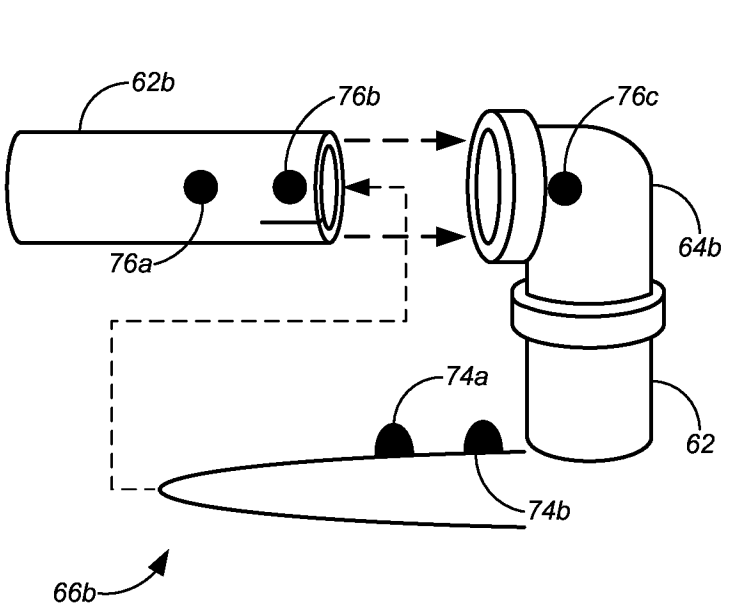
FIGS. 14 and 15 are exploded detail drawings illustrating an attachment mechanism for connecting two members of a collapsible, portable frame, in accordance with various embodiments.
Figure 14:
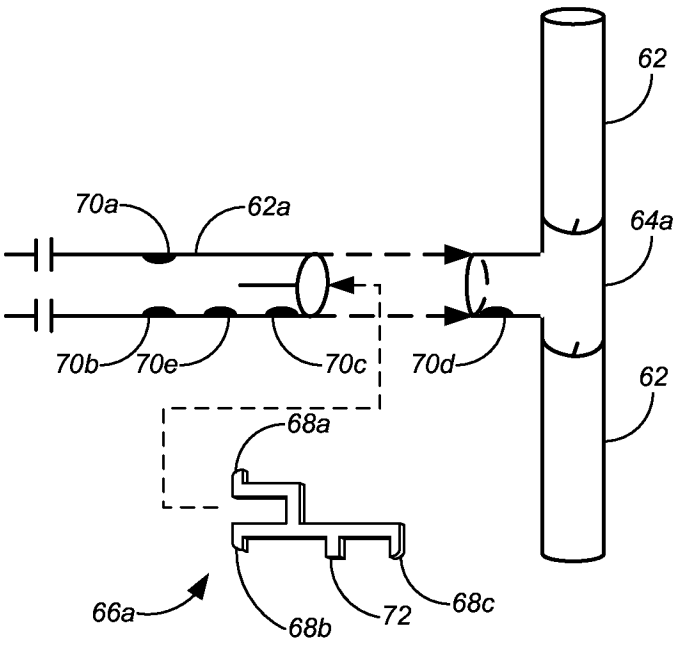

Merely by way of example, FIGS. 12 and 13 illustrate a collapsible, portable frame 60 that comprises a plurality of frame members 62 and a plurality of connecting members 64. The frame 60 is shown in an assembled configuration in FIG. 12 and an unassembled configuration in FIG. 13. As shown by FIGS. 14 and 15, an attachment mechanism 66 similar to the mechanism 18 described above can be used to attach the frame members 62 to the connecting members 64. Notably, the frame 60 employs both T-connectors 64*a* and elbow connectors 64*b*.

Various configurations of the frame 60 are possible. In some cases, each of the frame members 62 is fixedly attached to one of the adjacent connecting members 64 and removably attached to the other adjacent connecting member 64, allowing full disassembly of the frame 60. In other cases, the frame members of the base might each be fixedly attached to a T-connector, which is removably attached from the adjacent uprights, which in turn might be fixedly attached to one or more T-connectors or elbow joints, each of which is removably attached to a crossbar, such that the frame can be disassembled into roughly similarly-sized base members, upright members, and crossbar members for storage or transportation.

In the embodiment illustrated by FIGS. 12-15, the principle behind the removable attachment between the frame members 62 and the connectors 64 is similar to that described above (in that an insertion portion of an end portion of the frame member 62 is inserted into the connecting member 64 and secured there by a catch 66), and these embodiments may employ kerf(s) and/or shaving to provide relief between the tubes 62 and the connecting members 64, as mentioned above. In these embodiments, however, each of the attachment mechanisms 66 has a slightly different configuration than the attachment mechanism 18 described above. In the embodiment illustrated by FIG. 14, the attachment mechanism 66*a* (which could be a plastic clip) features two catches 68*a* and 68*b* that extend through corresponding holes 70*a* and 70*b* in the frame member, along with a catch 68*c* that extends through corresponding hole 70*c* in the frame member and at least partially through hole 70*d* in the connector 64*a*. The attachment mechanism in the current embodiment features a single pushbutton 72 that extends through a hole 70*e* in the non-insertion portion of the frame member 62*a*. When sufficient force is applied to the pushbutton 72, the catch 68*c* withdraws from the hole 70*d* in the connector 64*a*, allowing the frame member 62*a* to be withdrawn from the connector 64*a*.

In the embodiment illustrated by FIG. 15, the attachment mechanism 66*b* (which might be constructed of a steel spring ribbon or other metal) is similar to the attachment mechanism 18 described above, except that it has protuberances 74 on only one of the legs of the attachment mechanism 66*b*. This embodiment can be useful in situations in which the frame members are relatively narrow (e.g., ½-inch pipe, to name one example). Similarly, the frame member 62*b* includes holes 76 on only one side (holes 76*a* and 76*b*, corresponding to protuberances 74*a* and 74*b*, respectively, as described in connection with the attachment mechanism 18 above), and the connection member 64*b* features one hole 76*c*, which aligns with hole 76*b* when the end portion of the frame member 62*b* is inserted into the connection member 64*b*, and through which the protuberance 74*b* extends at least partially to secure the connection. As noted above, when sufficient force is applied to the pushbutton 74*a*, the catch 74*b* withdraws from the hole 76*c*, allowing the end portion of the frame member 62*b* to be removed from the connecting member 64*b*. Variations are possible as well. For example, in some cases, the leg without the protuberances can be affixed (e.g., with rivets, etc.) to the interior surface of the exterior wall of the frame member and/or embedded in the exterior wall. Additionally and/or alternatively, the leg without the protuberances can be omitted altogether (such that the attachment mechanism 66*b* is essentially linear, except for the protuberances 74), attachment mechanism 66*b* could be affixed to and/or embedded within the exterior wall of the frame member 62*b*, such that the protuberances 74*a* and 74*b* align with the holes 74*a* and 74*b* when the attachment mechanism 66*b* is affixed to (or partially embedded within) the wall of the frame member 62*b*.

It should be noted that these attachment mechanisms 66*a* and 66*b* and attachment mechanism 18 described above can be substituted for one another (with corresponding adjustments in the holes of the frame members and/or connecting members with which the attachment mechanisms are used), in accordance with various embodiments. Moreover, based on the disclosure herein, one skilled in the art can appreciate that a variety of different types of attachment mechanisms can be implemented in accordance with various embodiments. Likewise, while the exemplary CPSG 10 described above employs only elbow joints, it should be appreciated that CPSGs in accordance with other embodiments might employ T-connectors (and/or other types of connecting members) as well. Merely by way of example, in the case of a CPSG with a wide goal mouth, the crossbars 12*b* and 12*e* might comprise multiple frame members, each connected with an inline connector (e.g., using the connection techniques described herein). In such an embodiment, the inline connectors might be replaced with T-connectors to add a center post (e.g., running behind the goal mouth from the top crossbar 12*b* to the back crossbar 12*e*) for additional stability.

Hence, it should be appreciated that, while certain features and aspects have been described with respect to exemplary embodiments, one skilled in the art will recognize that numerous modifications are possible. Merely by way of example, while various embodiments are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A collapsible, portable sport goal, comprising:

a plurality of frame members, including a first frame member having a first connecting member fixedly attached to a first end portion of the first frame member, the first frame member further comprising a second end portion, the second end portion having an insertion portion adapted to be removably inserted within a second connecting member and a non-insertion portion that remains outside the second connecting member when the insertion portion is inserted within the second connecting member, the insertion portion having removed therefrom at least two kerfs, the second end portion further defining first, second, third, and fourth holes in one or more exterior walls of the first frame member, the first hole and the third hole being disposed within the insertion portion, with the first hole opposing the third hole, and the second hole and the fourth hole being disposed within the non-insertion portion, with the second hole opposing the fourth hole, and the second connecting member defining opposing fifth and sixth holes in one or more exterior walls of the second connecting member, wherein, when the insertion portion is inserted within the connecting member, the fifth hole aligns with the first hole and the sixth hole aligns with the third hole;

an attachment mechanism disposed within the second end portion and configured to secure the insertion portion within the second connecting member, each of the kerfs being perpendicular to an alignment of the attachment mechanism within the second end portion, the attachment mechanism comprising a first leg having a first protuberance and a second protuberance, and a second leg generally opposing the first leg, the second leg having a third protuberance and a fourth protuberance, wherein:

the first protuberance extends through the first hole and at least a portion of the fifth hole, the second protuberance extends through the second hole, the third protuberance extends through the third hole and at least a portion of the sixth hole, and the fourth protuberance extends through the fourth hole;

when the insertion portion is inserted within the second connecting member, the first and third protuberances secure the insertion portion within the second connecting member; and when sufficient force is applied to the second protuberance, the first protuberance withdraws from the fifth hole and when sufficient force is applied to the fourth protuberance, the third protuberance withdraws from the sixth hole, allowing the insertion portion to be removed from the second connecting member; and a net attached to one or more of the plurality of frame members.

2. The collapsible, portable sport goal of claim 1, wherein the attachment mechanism comprises a bar that is formed into an acute angle and disposed within the second end portion, with a vertex of the acute angle oriented generally toward the second connecting member.

3. The collapsible, portable sport goal of claim 2, wherein the bar is fashioned from a metal.

4. The collapsible, portable sport goal of claim 3, wherein the bar is a steel spring bar.

5. The collapsible, portable sport goal of claim 2, wherein the protuberances are stamped into the bar.

6. The collapsible, portable sport goal of claim 2, wherein the protuberances are affixed to the bar.

7. The collapsible, portable sport goal of claim 1, wherein the frame members comprise plastic pipe, and wherein at least some of the connecting members are elbow connectors.

8. The collapsible, portable sport goal of claim 7, wherein at least some of the connecting members are T-connectors.

9. The collapsible, portable sport goal of claim 1, wherein the frame members have a circular cross section.

10. The collapsible, portable sport goal of claim 1, wherein the frame members have a rectangular cross section.

11. A collapsible, portable sport goal, comprising:

a plurality of frame members, including a first frame member having a first connecting member fixedly attached to a first end portion of the first frame member, the first frame member further comprising a second end portion, the second end portion having an insertion portion adapted to be removably inserted within a second connecting member and a non-insertion portion that remains outside the second connecting member when the insertion portion is inserted within the second connecting member, the insertion portion having removed therefrom at least two kerfs to provide relief between an outside perimeter of the insertion portion and an inside perimeter of the second connecting member, the second end portion defining first, second, third, and fourth holes in one or more exterior walls of the first frame member, the first hole and the third hole being disposed within the insertion portion, with the first hole opposing the third hole, and the second hole and the fourth hole being disposed within the non-insertion portion, with the second hole opposing the fourth hole, and the second connecting member defining opposing fifth and sixth holes in one or more exterior walls of the second connecting member, wherein, when the insertion portion is inserted within the connecting member, the fifth hole aligns with the first hole and the sixth hole aligns with the third hole;

an attachment mechanism disposed within the second end portion and configured to secure the insertion portion within the second connecting member, each of the kerfs being perpendicular to an alignment of the attachment mechanism within the second end portion, the attachment mechanism comprising a first leg having a first protuberance and a second protuberance, and a second leg generally opposing the first leg, the second leg having a third protuberance and a fourth protuberance, wherein:

the first protuberance extends through the first hole and at least partially through the fifth hole, the second protuberance extends through the second hole, the third protuberance extends through the third hole and at least partially through the sixth hole, and the fourth protuberance extends through the fourth hole;

when the insertion portion is inserted within the second connecting member, the first and third protuberances secure the insertion portion within the second connecting member; and when sufficient force is applied to the second protuberance, the first protuberance withdraws from the fifth hole and when sufficient force is applied to the fourth protuberance, the third protuberance withdraws from the sixth hole, allowing the insertion portion to be removed from the second connecting member; and a net attached to each of the plurality of frame members, the net comprising a plurality of cords, at least one sleeve disposed around at least a portion of the first frame member, and a reinforcing element, wherein the reinforcing element is woven through adjacent cords of the net and secured to the sleeve;

wherein the collapsible portable sport goal has an assembled configuration in which the frame members define a goal mouth that rests generally upright upon the ground to receive a ball or puck into the net and an unassembled configuration in which all of the frame members are generally parallel and disposed adjacently; and wherein the collapsible portable sport goal is adapted to be disassembled from the assembled configuration to the unassembled configuration, and assembled from the unassembled configuration to the assembled configuration, while the net remains attached to each of the plurality of frame members.

* * * * *